US010851785B2

(12) United States Patent
Peters et al.

(10) Patent No.: US 10,851,785 B2
(45) Date of Patent: Dec. 1, 2020

(54) COMPRESSOR SYSTEM WITH VARIABLE BLOWDOWN CONTROL

(71) Applicant: Ingersoll-Rand Company, Davidson, NC (US)

(72) Inventors: Michael Peters, Mooresville, NC (US); Michael R. Borkowski, Concord, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 679 days.

(21) Appl. No.: 14/967,524

(22) Filed: Dec. 14, 2015

(65) Prior Publication Data

US 2016/0186756 A1 Jun. 30, 2016

Related U.S. Application Data

(60) Provisional application No. 62/098,455, filed on Dec. 31, 2014.

(51) Int. Cl.

| | |
|---|---|
| ***F04C 29/02*** | (2006.01) |
| ***F04D 29/063*** | (2006.01) |
| ***F04B 39/02*** | (2006.01) |
| ***F04B 41/02*** | (2006.01) |
| ***F04D 29/70*** | (2006.01) |
| ***F04D 31/00*** | (2006.01) |
| *F04C 18/16* | (2006.01) |

(52) U.S. Cl.

CPC ..... *F04C 29/026* (2013.01); *F04B 39/0207* (2013.01); *F04B 39/0276* (2013.01); *F04B 39/0284* (2013.01); *F04B 41/02* (2013.01); *F04C 29/021* (2013.01); *F04D 29/063* (2013.01); *F04D 29/701* (2013.01); *F04D 31/00* (2013.01); *F04C 18/16* (2013.01); *F04C 2270/185* (2013.01)

(58) Field of Classification Search

CPC ..... F04C 29/026; F04C 29/021; F04C 2270/185; F04C 18/16; F04D 29/701; F04D 31/00; F04D 29/063; F04B 41/02; F04B 39/0276; F04B 39/0207; F04B 39/0284

See application file for complete search history.

(56) References Cited

U.S. PATENT DOCUMENTS

| | | | | |
|---|---|---|---|---|
| 4,595,035 A | | 6/1986 | Warrick | |
| 5,388,967 A | * | 2/1995 | Firnhaber | F04B 49/03 251/63.4 |
| 5,606,992 A | | 3/1997 | Erickson et al. | |

(Continued)

*Primary Examiner* — Charles G Freay
*Assistant Examiner* — Lilya Pekarskaya
(74) *Attorney, Agent, or Firm* — Taft Stettinius & Hollister LLP

(57) ABSTRACT

A compressor system is disclosed with at least one fluid compressor for compressing a working fluid. At least one separator tank is structured to receive compressed working fluid from the compressor and separate air and lubricating fluid from the working fluid. A lubrication supply conduit is fluidly coupled between the separator tank and at least one compressor for supplying lubrication from the separator tank to the compressor. A blowdown pressure control valve is fluidly coupled to the separator tank. A controller is connected to the blowdown pressure control valve to control a pressure in the separator tank to a predetermined pressure at a compressor operating condition.

11 Claims, 3 Drawing Sheets

(56) References Cited

U.S. PATENT DOCUMENTS

| | | | | |
|---|---|---|---|---|
| 5,713,724 | A * | 2/1998 | Centers | F04B 49/065 417/53 |
| 6,019,120 | A | 2/2000 | Najmolhoda et al. | |
| 6,533,552 | B2 | 3/2003 | Centers et al. | |
| 8,308,446 | B2 * | 11/2012 | Tang | F04B 41/00 417/292 |
| 8,360,738 | B2 * | 1/2013 | Van Den Wyngaert | F04C 18/16 417/307 |
| 9,109,600 | B2 * | 8/2015 | Wu | F04C 18/16 |
| 2008/0286087 | A1 * | 11/2008 | Nagesh | F04C 18/16 415/17 |
| 2014/0102382 | A1 * | 4/2014 | Kemp | F22B 37/565 122/382 |

* cited by examiner

COMPRESSOR SYSTEM WITH VARIABLE BLOWDOWN CONTROL

CROSS REFERENCE TO RELATED APPLICATIONS

This application claims the benefit of U.S. Provisional Application No. 62/098,455, filed Dec. 31, 2014, which is incorporated herein by reference in its entirety.

TECHNICAL FIELD

The present application generally relates to industrial air compressor systems and more particularly, but not exclusively, to a compressor system having variable blowdown control system.

BACKGROUND

Industrial compressor systems are configured to produce large volumes of pressurized fluid such as air or the like. Some compressor systems have lubricating fluid entrained with the compressed air through portions of the system. The lubrication can be driven from a holding or separator tank to the compressor via pressure in the separator tank. The compressor system needs a continuous supply of lubrication under all operating conditions from idle or an unloaded condition to a fully loaded condition. If the separator tank has too much pressure for a particular operating condition then the compressor system uses more energy than needed and thus loses efficiency rating. If the separator tank is under pressurized at a particular operating condition, the compressor can be starved for lubrication which will lead to durability problems and can ultimately lead to mechanical failure. Some existing systems have various shortcomings relative to certain applications. Accordingly, there remains a need for further contributions in this area of technology.

SUMMARY

One embodiment of the present invention is a unique compressor system with a variable blowdown control system. Other embodiments include apparatuses, systems, devices, hardware, methods, and combinations for compressor systems with a unique method of controlling pressure in an air/oil separator holding tank across a range of operating conditions. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
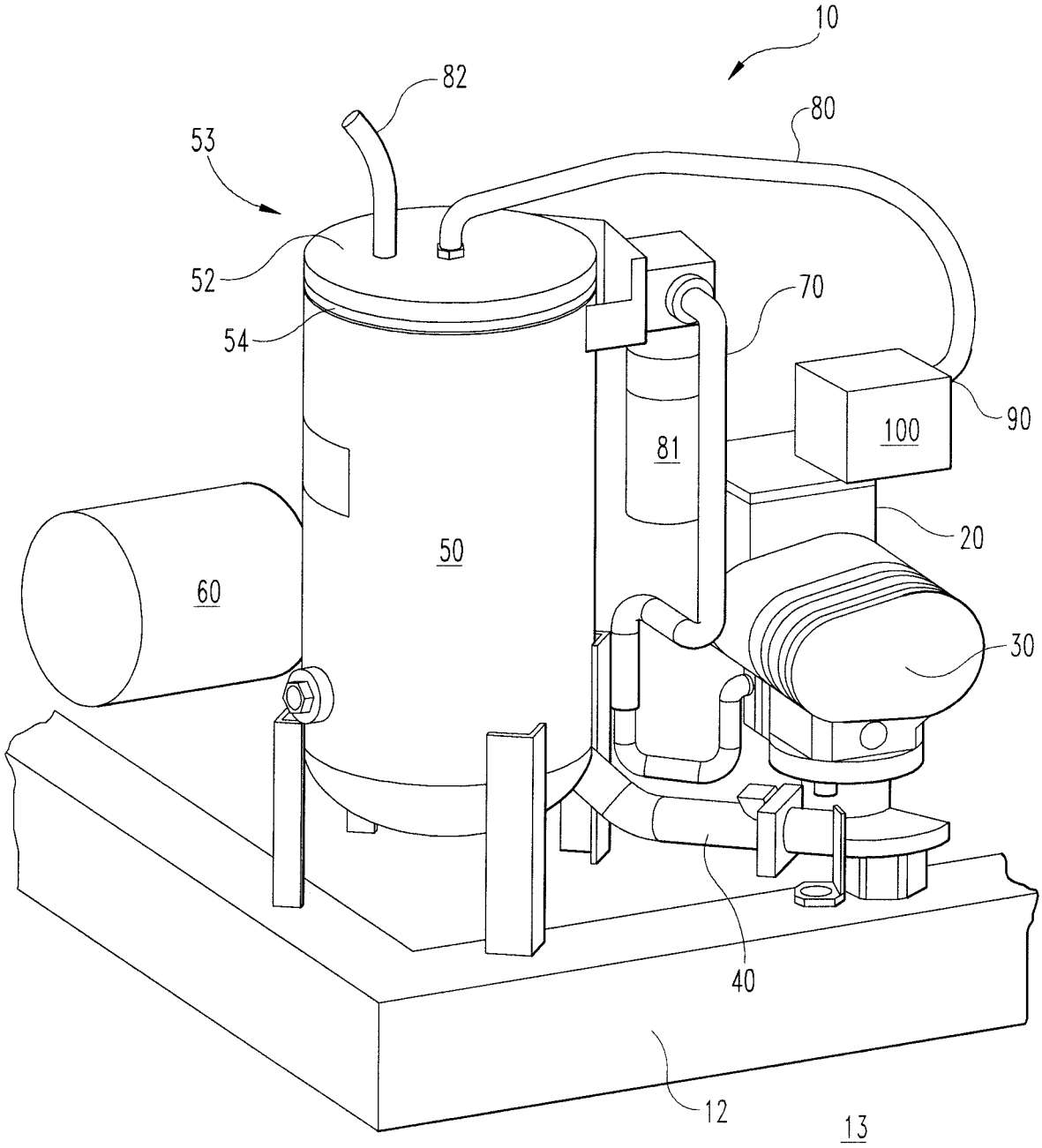
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide large quantities of compressed fluids at a desired temperature, pressure and mass flow rate. Some compressor systems include fluid to fluid heat exchangers to control the temperature of a compressed fluid at various stages within the system. The term "fluid" should be understood to include any gas or liquid medium used in the compressor system as disclosed herein. In one aspect the fluid can include mixtures of air and oil and can be separated into separate constituents in a separating tank. In one aspect this disclosure is directed to a working fluid that includes compressed air, however it should be understood that when the term "air" is used in the specification or the claims that other working fluids are included under a broad definition of compressible fluids. Also when the term "oil" is used in the specification or claims, it should be understood that any lubrication fluid whether carbon based or synthetic in nature is contemplated herein. The present disclosure provides an apparatus and method for controlling pressure within the separator tank to provide adequate lubrication to the compressor while maximizing system efficiency over a range of operating conditions.

Referring now to FIG. 1, an exemplary compressor system 10 is shown therein. The compressor system 10 includes a primary motive source 20 such as an electric motor, an internal combustion engine or a fluid-driven turbine and the like. The compressor system 10 can include a compressor 30 that may include multi-stage compression. The compressor 30 can include a screw, centrifugal, axial and/or positive displacement compression means. The primary motive source 20 is operable for driving the compressor 30 via a drive shaft (not shown) to compress gaseous working fluids such as air and oil vapor or the like.

A structural base 12 is configured to support at least portions of the compressor system 10 on a support surface 13 such as a floor or ground. Portions of the compressed working fluid discharged from the compressor 30 can be transported through one or more conduits 40 to a sump or separator tank 50 for separating fluid constituents such as air and oil or the like. One or more coolers 60 can be operably coupled with the system 10 for cooling working fluids to a desired temperature. The one or more coolers 60 can cool working fluids such as compressed air or oil to a desired temperature. The compressor system 10 can also include a controller 100 operable for controlling the primary motive power source 20 and various valving and fluid control mechanisms (not shown) between the compressor 30 and intercoolers 60 such as a blowdown valve 90.

The separator tank 50 can include a lid 52 positioned proximate a top portion 53 thereof. A seal 54 can be positioned between the lid 52 and separator tank 50 so as to provide a fluid tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. An air supply conduit 82 can be operably coupled to the separator tank so as to deliver compressed air to a separate holding tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10.

Figure 2:
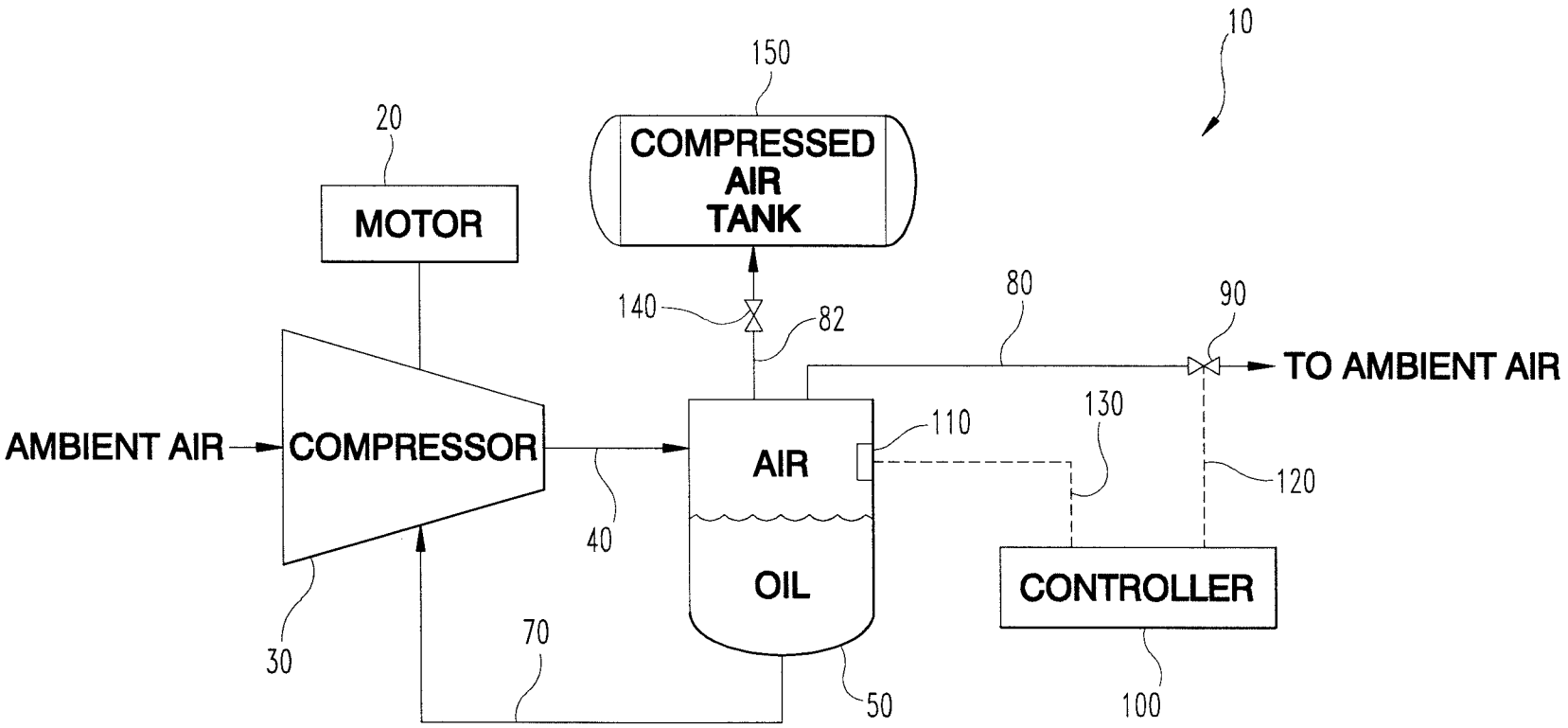
FIG. 2 is a schematic view of a portion of the compressor system of FIG. 1 illustrating a variable blowdown control system according to an embodiment of the present disclosure.

Referring now to FIG. 2, a portion of the compressor system 10 is shown in schematic form. In operation the compressor 30 draws in ambient air and compresses the ambient air along with other entrained fluids such as oil vapor and the like. The compressor 30 delivers the compressed fluid to the air/oil separator tank 50 via conduit 40 so that fluid constituents can be separated. The air/oil separator tank 50 can include other working components (not shown) such as filters, heat exchangers, fluid conduits and other apparatus operable to separate the air and oil as would be known to the skilled artisan. Once the air and oil are separated, oil is delivered through the oil supply conduit 70 back to the compressor 30 for lubrication means.

In one form, the compressor 30 operates continuously during loaded and unloaded conditions. A loaded condition as defined herein, is an operating condition wherein the compressor 30 delivers compressed air to an end load for use in pneumatic tools or other industrial applications. When demand for compressed air is satisfied such as when a compressed air storage tank 150 is fully pressurized, the compressor is unloaded and downstream pressure can be reduced by releasing compressed air through a blow down conduit 80 that is operably connected to the separator tank 50. When a blow down valve 90 connected to the blow down conduit 80 is opened, compressed air is discharged from the separator tank 50 and released to ambient air in some embodiments.

The controller 100 can include one or more communication lines 120, 130 that are operably coupled to a plurality of sensors 110 and to one or more control valves such as the blow down valve 90. The sensors 110 can include pressure and temperature sensors to monitor conditions within the separator tank 50. Furthermore it is contemplated that pressure, temperature and mass flow rate or other sensed parameters can be monitored at any desirable location within the system 10. The controller 100 can be operably connected to motor 20 and to compressor loading sensors that define an operating state of the compressor. In one form compressor loading sensors can monitor a pressurized air tank to determine whether additional compressed air is required at any point in time. When the compressor is unloaded, the blow down valve will open and the supply check valve 140 positioned in fluid communication between the separator tank 50 and the compressed air tank 150 along a compressed air supply tank conduit 82 will close to prevent backflow of compressed air into the separator tank 50.

Lubrication fluid such as oil is supplied to the compressor via an oil supply line 70 connected to the separator tank 50, therefore a minimum predefined pressure must be maintained in order to supply the required mass flow rate of lubrication fluid at all operating conditions. When the compressor 30 is loaded, the blow down valve 90 is closed and the compressor discharge air is delivered to an end load such as the compressed air tank 150. During loaded operating conditions the pressure in the separator tank 50 is sufficient to adequately supply lubricant to the compressor 30.

If the compressor 30 is unloaded and the blow down valve 90 is closed, then the compressor will operate with an unnecessarily high back pressure which causes inefficient operation as the compressor is compressing fluid that is not being delivered to an end load. Operating the compressor system 10 in this manner wastes energy. By lowering the pressure in the separator tank 50 to a minimum predefined pressure necessary to supply adequate lubricant flow to the compressor 30, the compressor 30 will use less energy and thus become more efficient. The method defined by the variable blowdown control system will provide for an increased operating efficiency of the compressor system 10.

Figure 3:
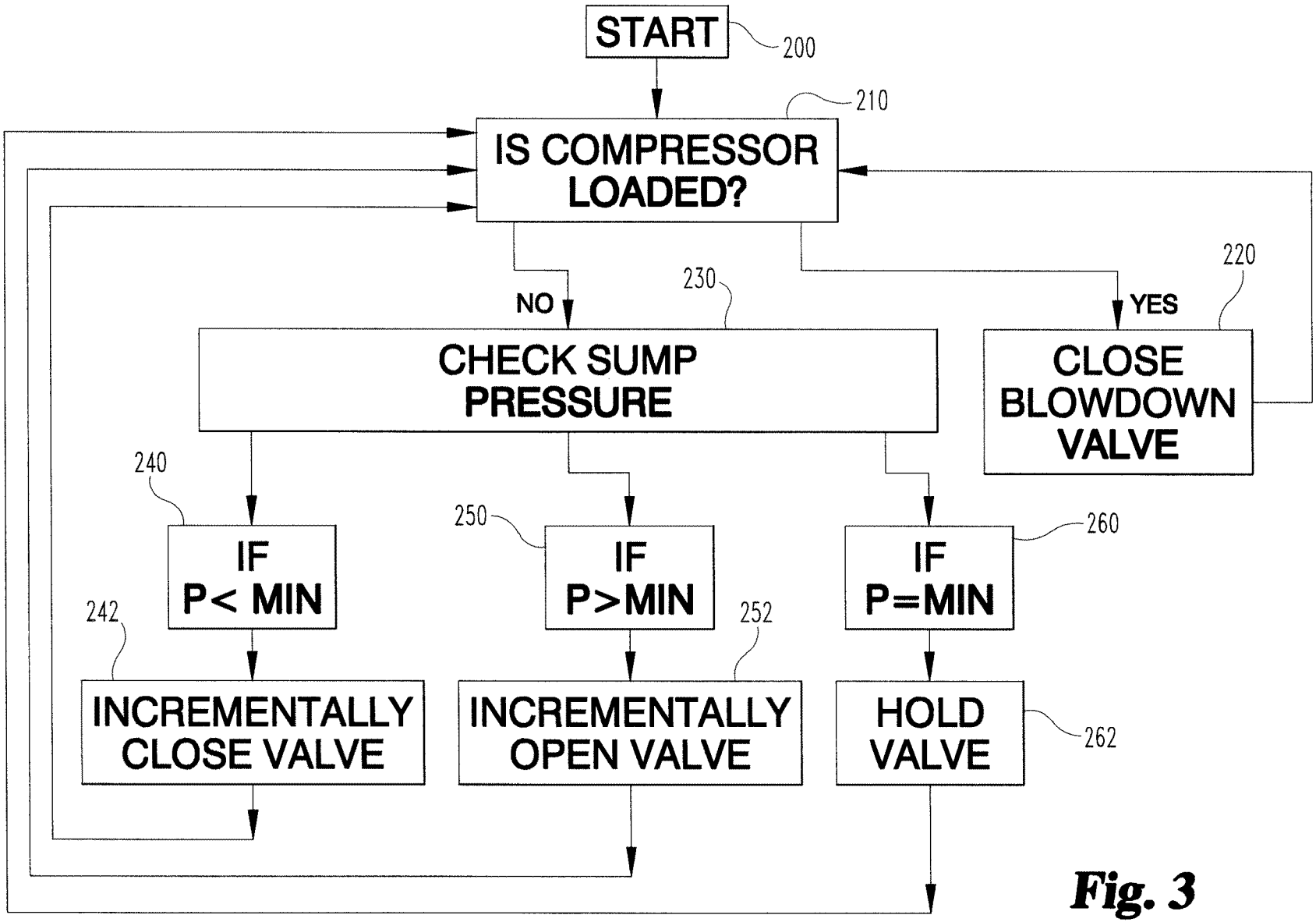
FIG. 3 is system flow chart illustrating operation of the variable blowdown control system of FIG. 2.

Referring now to FIG. 3, an exemplary control method for operating the compressor system 10 is illustrated herein. The control method starts at step 200. The control system determines if the compressor is loaded at step 210. If the compressor is loaded then the control system closes the blow down valve at step 220 and continues to monitor the compressor system. If the compressor is unloaded, the control system senses absolute pressure or an indicated pressure in the separator tank or sump 50 at step 230. A predefined minimum pressure for a plurality of operating conditions is stored in memory for the control system to compare with the indicated sump pressure. If the indicated pressure is less than the minimum pressure at step 240, the control system will incrementally close the blow down valve 90 at step 242 to increase the pressure in the sump 50. The control system continuously loops back to step 210 to determine if the compressor 30 is loaded. If the indicated pressure is greater than the minimum pressure as illustrated in step 250, then the control system will incrementally open the blow down valve 90 at step 252 and the control system will loop back to step 210 to determine if the compressor 30 is loaded. If at step 230 the pressure is equal to the minimum pressure at step 260, then the control system will hold the blow down valve 90 at its current position at step 262 and the control system will loop back to step 210 to monitor the compressor loading status. In this manner the control system continuously monitors the status of the compressor loading and controls the sump pressure such that the compressor system operates at maximum efficiency while providing adequate lubrication to the compressor system.

In operation the compressor system is configured to provide compressed air at a desired temperature and pressure to external systems. The compressor systems can be used in any industrial application including, but not limited to automobile manufacturing, textile manufacturing, process industries, refineries, power plants, mining, material handling, etc. The controller permits user input to define parameters such as pressure, temperature and mass flow rate of a working fluid. The controller will send command signals to the motor to rotate at a desired operating speed in order to drive the one or more compressors and control various valving to control airflow rate, coolant flow rate and/or lubrication flow rates.

In the illustrative example, the compressor system includes a single-stage screw type compressor system, however, the system can operate with other types of compressors and/or with more or less stages of compressors. One or more intercoolers can be fluidly coupled to each compressor stage such that after air is compressed through the first stage the air can be transported through a first intercooler and can be cooled to a desired temperature via a heat transfer mechanism such as conduction and convection in tube type heat exchangers.

The compressed air can then be transported to additional compressor stages where the air is further compressed and necessarily heated to a higher temperature through a thermodynamic process. The compressed air can then be routed through subsequent intercooler stages coupled to the closed loop water cooling system to cool the air to a desired temperature without substantial loss of pressure. When the air is compressed to a final desired pressure and cooled to a desired temperature, the compressed air is discharged to a final subsystem or end load.

In one aspect, the present disclosure includes a compressor system comprising: at least one fluid compressor for compressing working fluid; at least one separator tank structured to receive compressed working fluid from the compressor and separating air and lubricating fluid from the working fluid; a lubrication supply conduit fluidly coupled between the separator tank and at least one compressor for supplying lubrication from the separator tank to the compressor; a blowdown pressure control valve fluidly coupled to the separator tank; and a controller operably connected to the blowdown pressure control valve to control a pressure in the separator tank to a predetermined pressure at a compressor operating condition.

In refining aspects, the present disclosure includes a compressor system wherein the controller provides a position signal to the blowdown control valve in response to a sensed condition within the separator tank; wherein the sensed condition includes at least one of a pressure and a temperature within the separator tank; wherein the controller commands the blowdown valve to move between a fully open position and a fully closed position to hold the separator tank at a desired pressure as a function of the compressor operating condition; wherein the desired pressure is a minimum predetermined pressure at an unloaded compressor operating condition; wherein the desired pressure corresponds to a predefined minimum lubrication flow rate at an unloaded compressor operating condition; wherein the blowdown valve is closed at a loaded compressor operating condition; wherein the compressed air tank is fluidly coupled to the separator tank for receiving compressed air; a second control valve fluidly coupled between the separator tank and the compressed air tank to control airflow into the compressed air tank; a motive source for rotating the compressor; where the controller is configured to receive a pressure signal indicating a pressure in the separator tank; receive a compressor loading signal; incrementally close the valve when the indicated pressure is below a desired pressure at an unloaded operating condition; incrementally open the valve when the indicated pressure is above a desired pressure at an unloaded operating condition; and close the valve at a loaded condition.

In another aspect, the present disclosure includes an apparatus comprising: an air compressor operable for compressing air; an an/oil separator tank fluidly connected to the compressor; an oil supply conduit extending between the separator tank and the compressor; an air/oil discharge conduit extending between the compressor and the separator tank; a blowdown valve coupled to separator tank; a control system operably connected to the blowdown valve to control pressure within the separator tank as a function of compressor loading.

In refining aspects, the present disclosure includes an apparatus wherein the control system includes at least one pressure sensor, temperature sensor and/or mass flow sensor; an electronic controller operable for receiving and transmitting control signals; closes the blowdown valve when the compressor is loaded; controls a blowdown pressure within the separator tank when the compressor is unloaded; defines a desired minimum pressure at an unloaded compressor operating point and transmits command signals to the blowdown valve to either incrementally close or incrementally open to reach the desired minimum pressure; wherein the air compressor includes more than one compression stage; and wherein the compressor is one of a screw, gear piston, or centrifugal type.

In another aspect, the present disclosure includes a method comprising: determining a compressor loading condition; sensing a pressure in a fluid separator tank; closing a blowdown valve when the compressor is loaded; incrementally closing the blowdown valve when the sensed pressure is less than a predetermined minimum pressure in an unloaded condition; incrementally opening the blowdown valve when the sensed pressure is greater than a predetermined minimum pressure in an unloaded condition; and holding the valve position if the sensed pressure is at the predetermined minimum pressure.

In refining aspects, the present disclosure is comprised of defining the predetermined minimum pressure to meet a desired lubrication flow rate; and minimizing the power usage of the compressor system at an unloaded condition while maintaining a desired lubrication flow rate.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

at least one fluid compressor for compressing a working fluid;

at least one separator tank structured to receive the working fluid that was compressed from the at least one fluid compressor and separate a lubricating fluid from the working fluid;

a lubrication supply conduit fluidly coupled between the at least one separator tank and the at least one fluid compressor for supplying the lubrication fluid from the at least one separator tank to the at least one fluid compressor;

a blowdown pressure control valve fluidly coupled to the at least one separator tank; and a controller which: (i) is configured to receive a pressure signal indicating a sensed pressure in the at least one separator tank, (ii) is operably connected to the blowdown pressure control valve, and (iii) provides a blowdown pressure control valve position signal to the blowdown pressure control valve to cause a movement of the blowdown pressure control valve in a response to the sensed pressure within the at least one separator tank and a desired pressure of the at least one separator tank at a compressor operating condition.

2. The compressor system of claim 1, wherein the controller provides a position signal to the blowdown control valve in response to a sensed condition within the at least one separator tank.

3. The compressor system of claim 2, wherein the sensed condition includes at least one of a pressure and a temperature within the at least one separator tank.

4. The compressor system of claim 2, wherein the controller commands the blowdown pressure control valve to move between a fully open position and a fully closed position to hold the at least one separator tank at the desired pressure as a function of the compressor operating condition.

5. The compressor system of claim 4, wherein the desired pressure is a minimum predetermined pressure at an unloaded compressor operating condition.

6. The compressor system of claim 4, wherein the desired pressure corresponds to a predefined minimum lubrication flow rate at an unloaded compressor operating condition.

7. The compressor system of claim 4, wherein the blowdown pressure control valve is closed at a loaded compressor operating condition.

8. The compressor system of claim 1, further comprising:

a compressed air tank fluidly coupled to the at least one separator tank for receiving compressed air.

9. The compressor system of claim 8, further comprising: a second control valve fluidly coupled between the at least one separator tank and the compressed air tank to control an airflow to and from the compressed air tank.

10. The compressor system of claim 1, further comprising:

a motive source for rotating the compressor.

11. The compressor system of claim 1, wherein the controller is configured to: receive a pressure signal indicating the sensed pressure in the at least one separator tank; receive a compressor loading signal; incrementally close the blowdown pressure control valve when the sensed pressure is below the desired pressure at an unloaded operating condition; incrementally open the blowdown pressure control valve when the sensed pressure is above the desired pressure at an unloaded operating condition; and close the blowdown pressure control valve at a loaded compressor operating condition.

* * * * *